US007954867B1

(12) United States Patent
Prechl

(10) Patent No.: US 7,954,867 B1
(45) Date of Patent: Jun. 7, 2011

(54) PICK UP DEVICE

(76) Inventor: Jozsef Prechl, Reseda, CA (US)

( * ) Notice: Subject to any disclaimer, the term of this patent is extended or adjusted under 35 U.S.C. 154(b) by 0 days.

(21) Appl. No.: 12/454,697

(22) Filed: May 21, 2009

(51) Int. Cl.
*A01K 29/00* (2006.01)

(52) U.S. Cl. ..... 294/1.4; 15/257.6; 15/104.8

(58) Field of Classification Search ..... 294/1.3, 294/1.4, 1.5; 15/104.8, 257.1, 257.4, 257.6, 15/257.7
See application file for complete search history.

(56) References Cited

U.S. PATENT DOCUMENTS 2,999,259 A * 9/1961 Polner ..... 15/104.8
3,431,008 A * 3/1969 Narita ..... 294/1.4
3,986,744 A * 10/1976 Krogstad et al. ..... 294/1.3
4,102,547 A * 7/1978 Williams ..... 294/1.3
4,368,907 A * 1/1983 Ross ..... 294/1.4
5,575,520 A * 11/1996 Northcutt ..... 294/55
5,667,264 A * 9/1997 Tanahara ..... 294/1.4
6,032,995 A * 3/2000 Barbaro ..... 294/1.4

* cited by examiner

*Primary Examiner* — Paul T Chin
(74) *Attorney, Agent, or Firm* — Colin P. Abrahams

(57) ABSTRACT

A pick up device comprises a container defining an interior space, the container having a front wall movable between an open position and a closed position and a rear wall movable between an open position and a closed position. A reciprocating arm is associated with the container and attached to the front wall for moving the front wall between the open position and the closed position. An activator is provided for activating movement of the front wall from the open position to the closed position. Further, a connector means is formed between the rear wall and the container allowing the rear wall to move between the open position and the closed position, the connector means permitting movement from the closed to the open position when the container is oriented at a suitable angle.

14 Claims, 5 Drawing Sheets

FIG. 5
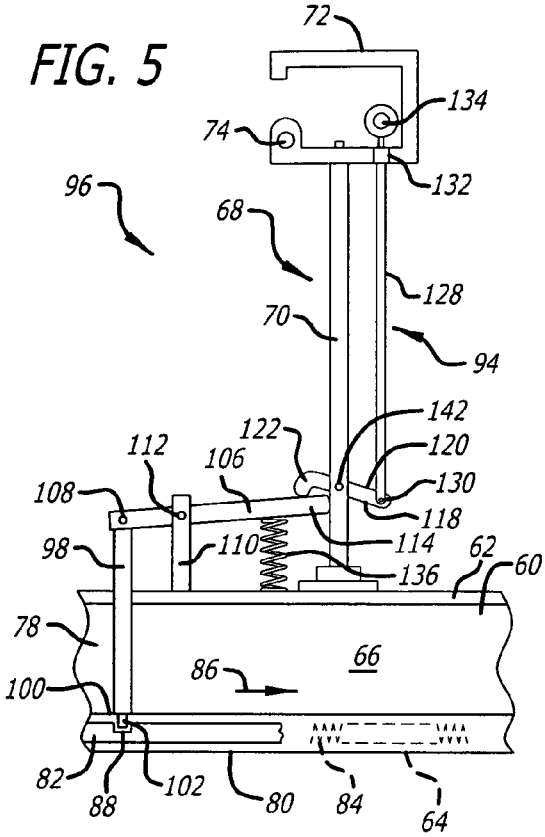
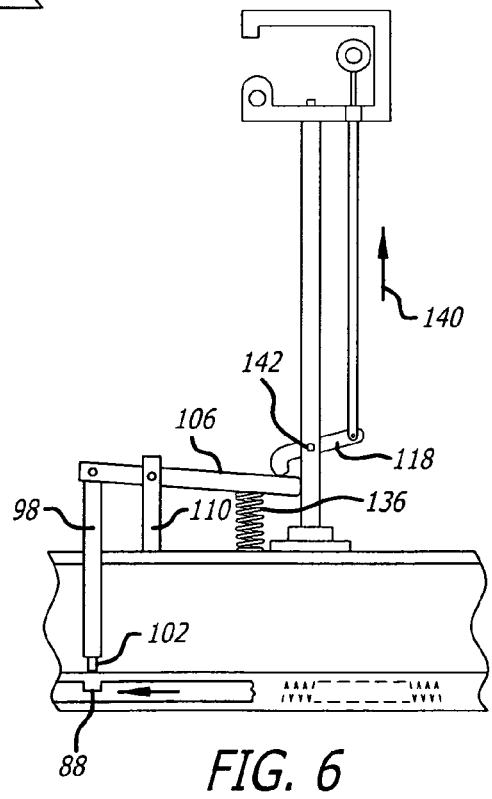
FIG. 6

PICK UP DEVICE

FIELD AND BACKGROUND OF THE INVENTION

This invention relates to a pick up device. More particularly, the invention relates to a hand held pick up device to assist the user thereof in picking up an object on the ground without having to touch the object and preferably without having to bend over. In one preferred context, the present invention is for a pick up device configured for the sanitary pick up, storage and disposal of animal waste.

Dogs are very common household pets and as is well known require frequent walks to stay healthy. Often, during the course of a walk, the dog will produce waste which should not only be picked up by the owner of the dog to prevent or reduce health hazards, but also because many cities and local governments have laws requiring the owner to clean up after his or her pet. The pick up device of the invention is one which can easily be carried by a dog owner during a walk. When needed, the pick up device can be effectively used to scoop up the waste into a container, and then hold the waste until a suitable method for disposal is reached. The pick up and storage does not require the pet owner to touch the waste at all, thereby making an unpleasant task much easier to carry out.

SUMMARY OF THE INVENTION

According to one aspect of the invention, there is provided a pick up device comprising: a container defining an interior space, the container having a front wall movable between an open position and a closed position and a rear wall movable between an open position and a closed position; a reciprocating arm associated with the container and attached to the front wall for moving the front wall between the open position and the closed position; an activator for activating movement of the front wail from the open position to the closed position; and connector means between the rear wall and the container allowing the rear wall to move between the open position and the closed position, the connector means permitting movement from the closed to the open position when the container is oriented at a suitable angle.

Preferably, the container is generally a box shaped receptacle and comprises an upper wall, a lower wall, and side walls, the front wall and rear wall cooperating with the upper, lower and side walls to form the receptacle.

The pick up device may further comprise a holding member, the holding member having a shaft with first and second ends, the first end of the shaft connected to the container and extending upwardly from the container, and a handle mounted on the shaft at or near the second end thereof.

Preferably, the activator comprises a channel formed on or in the container, the channel accommodating the reciprocating arm; a biasing member urging the reciprocating arm into the channel so as to move the front wall to the closed position; stop means for maintaining the reciprocating arm in the channel against the bias of the biasing member; and a release mechanism for selectively releasing the reciprocating arm from the stop means to allow the biasing member to thereby permit movement of the reciprocating arm to move the front wall to the closed position.

In another embodiment, the activator may be configured to move the front wall from the closed to the open position.

The channel may be an open channel or is a substantially closed channel.

In one embodiment, the release mechanism comprises a trigger arm operable by a user, a catch bar which engages the reciprocating arm, and a pivoted lever arm between the trigger arm and the catch bar, the lever arm being biased so that the catch bar normally engages the reciprocating arm and being pivotable by the trigger arm to disengage the catch bar from the reciprocating arm.

In one aspect of the invention, two reciprocating arms are provided each on a side of the container, each of the reciprocating arms being connected at one end thereof to a side edge of the front wall.

Preferably, the rear wall is hingedly connected to the container at a top edge thereof such that the rear will open by rotating at the hinge when the container is oriented at a suitable position. Further, a weight may be attached to the rear wall of the container to stabilize the rear wall.

In one form, a bump is formed on the container on a bottom wall thereof adjacent the front wall, the bump preventing an object in the container from falling out of the interior space thereof. The pick up device may further comprise a handle formed on the front wall of the container to pull or push the front wall to a desired position. Usually, the handle is used to open the front wall and the activator mechanism is used to close the front wall. There may also be a handle formed on the upper wall of the container to hold the pick up device in place while the handle on the front wall is being pulled open.

Preferably, the biasing means is a spring formed in the channel, one end of the spring acting on the reciprocating arm, an other end of the spring acting on a wall in the chamber.

According to another aspect of the invention, there is provided a method of picking up an object from a surface, the method comprising: forming a pick up device comprising a container defining an interior space, the container having a front wall movable between an open position and a closed position and a rear wall movable between an open position and a closed position; providing a reciprocating arm associated with the container on the front wall for moving the front wall between the open position and the closed position; activating the front wall to move from the open position to the closed position; locating the object between the open front wall and the interior space of the container; moving the front wall back to the closed position in a manner that moves the object into the interior space; and opening the rear wall by tilting the container so that the object falls out of the interior space into a receptacle.

BRIEF DESCRIPTION OF THE DRAWINGS

In the drawings:

FIG. 5 is a schematic side view of one embodiment of the invention showing a closing mechanism for the pickup device, in the rest position;

FIG. 6 is a view similar to that shown in FIG. 5, with the closing mechanism triggered so as to facilitate closing of the pickup device;

DETAILED DESCRIPTION OF THE INVENTION

Figure 1:
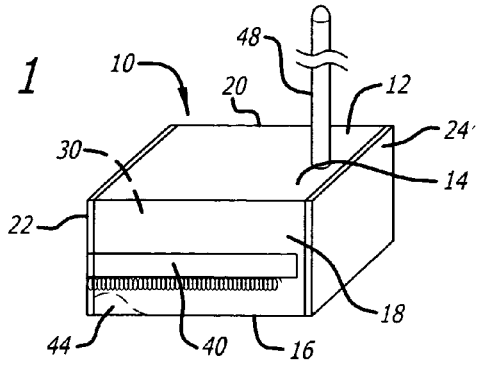
FIG. 1 is a side perspective view of a pickup device in accordance with one aspect of the invention, in the initial closed position.

The present invention relates to a pickup device to aide a person in picking up objects off the ground. The pickup device has a particular application with respect to picking up pet animal waste, and other objects where direct contact with the object to be picked up may be either unsanitary or unpleasant.

The pickup device of the invention generally comprises a box-shaped or otherwise enclosed structure defining a space, and having a front door and a rear door. In use, the front door or wall can be opened in one version of the invention by means of pulling a handle on the front door and then closed by activating a trigger on the device so that the front door or wall will spring shut. The object to be picked up is then placed between the open front door and the space defined by the box or container, and subsequent closing of the front door will move the object into the space. The pickup device also has a rear door through which the waste can subsequently be disposed of. The rear door, which may be hinged at its upper edge to the container, will typically pivot to an open position when the pickup device is oriented appropriately. The opening formed by the rear door allows the object contained within the space to fall out of the space and into another trash container.

The space may contain removable or replaceable paper or plastic bags, sacks or other devices to capture the object when in the space to prevent soiling of the container due to direct contact between the container and the object.

In accordance with the invention, the container may have an elongate handle which is attached to the box and extends upwardly. The handle has a portion which is grasped by the user. A trigger mechanism extends from the container to the handle so that the user can conveniently pull the trigger or activator and cause the door or wall to close, after it has been manually opened, preferably in a spring-like fashion. Further, the handle may have at some point along its length or structure a means or fastening point to which a leash can be attached. In this way, the user has the convenience of holding a single device instead of both the pickup device and the leash which is usually attached to an animal such as a dog when the pickup device is used.

Different mechanisms whereby the front door of the pickup device can be opened and thereafter sprung closed, may be provided in accordance with the invention. Various options are set out below with reference to the drawings, but these are not intended to be exhaustive or definitive.

Reference is now made to FIGS. 1 to 4 of the drawings, which show the pickup device of the invention and sequential operation thereof for picking up an object. In these figures, the pickup device 10 comprises a container 12 having a top wall 14, a bottom wall 16, side wall 18 and side wall 20. Further, the pickup device 10 has a front wall 22 and a rear wall 24. The front and rear walls 22 and 24 respectively are capable of opening, each in different ways, in order to effect pickup of an object 26 located on the ground surface, and which needs to be picked up or removed. In a typical example of the type of object 26 to be picked up, this may be animal pet waste. The pickup device 10 can be used by the user to pick up animal waste in a residential backyard, or the like, or can be taken on walks with the pet so as to pick up animal waste which may be deposited by the animal during the walk.

The container 12 has various walls as described above, all of which are located relative to each other to define an interior space 30.

Figure 2:
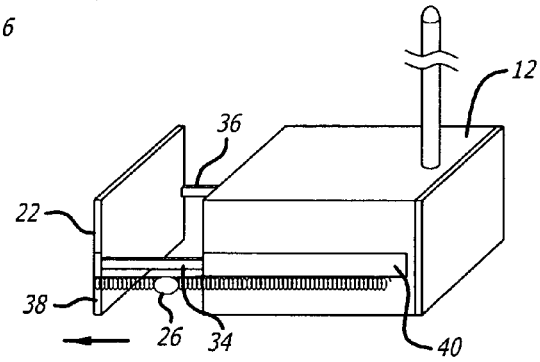
FIG. 2 is the pickup device as shown in FIG. 1 of the drawings moved to the open position, configured to pick up an object.

As shown in FIG. 2 of the drawings, the front wall 22 is supported by a pair of lateral arms 34 and 36. One end of each of the arms 34 and 36 is attached to the side edge 38 of the front wall 22, typically about midway along its length, although the attachment can be at any convenient location on the front wall 22. The side walls 18 and 20 each have on the outside thereof an enclosed or partly enclosed channel 40, and the lateral arms 34 and 36 each move axially, or along their length, in and out of their respective channels 40. When the front wall 22 is in the extended or open position, as shown in FIG. 2, each of the lateral arms 34 and 36 extends to the maximum outside of the channels 40. When the front wall 22 is closed, such as in FIGS. 1 and 3, the front wall 22 is moved back against the remainder of the container 12, and the lateral arms 34 and 36 are accommodated in the channels 40, so as to enclose or seal off the interior space 30.

Figure 3:
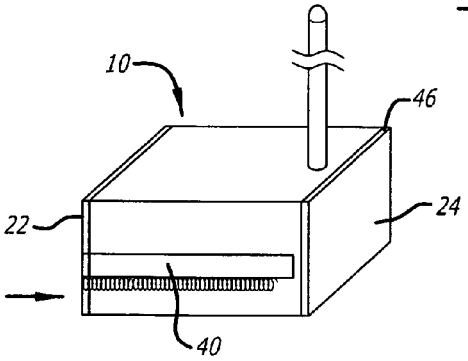
FIG. 3 is a pickup device as shown in FIG. 2 of the drawings, once again in the closed position after picking up the object.
Figure 4:
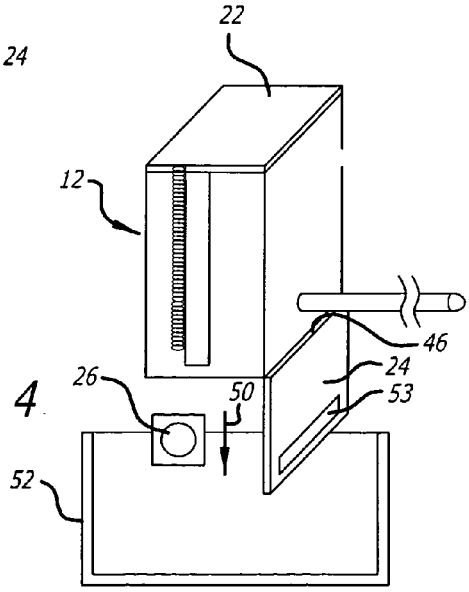
FIG. 4 is a perspective view of the device shown in FIGS. 1, 2 and 3 oriented so as to dispose of the object in an appropriate manner.

Different mechanisms may be used to effect or control the opening and closing movement of the front wall 22 of the container 12. In one embodiment, each of the channels 40 may have enclosed therein or on the outside thereof a spring, which in normal circumstances urges the lateral arms 34 and 36 into the channel 40, as shown for example in FIGS. 2 and 3. When moved into the open position by manually opening the front wall 22, some type of locking mechanism, one embodiment of which will be described below, would engage the lateral arms 34 and 36 in their respective channels 40, so as to prevent inward axial movement and thus closing of the front wall 22. The release of the locking mechanism by an appropriately controlled trigger would allow the springs and lateral arms 34 and 36 to pull the front wall 22 into the closed position, as shown in FIG. 3.

Additionally, in order to prevent the lateral arms 34 and 36 from completely exiting the channel 40, various stops and/or abutments may be configured on the lateral arms 34 and 36, and/or the channels 40 respectively, to limit the extent of movement of the front wall 22 when manually pulled out to the open position by the user.

In FIG. 1 of the drawings, the pickup device 10 is shown in the rest, or initial state. When it becomes necessary to pick up an object 26, the front wall 22 is manually opened using a handle. An appropriate trigger, one embodiment of which will be described below, is then activated to close the front wall 22, so that the front wall 22 moves toward the remainder of the container 12. When the front wall 22 is opened, the front part of the container 12 would therefore be open, providing ingress to the interior space 30. As will be seen in FIG. 2 of the drawings, the container 12 is lowered onto a surface with the bottom wall 16 on the surface, so that the object 26 is located between the container 12 and the open front wall 22. When in this position, the front wall or door 22 is then trigger activated so that the trigger pulls it back into the closed position, as seen in FIG. 3. In moving the front wall 22 to the closed position, the front wall 22 at the same time pushes the object 26 into the interior space 30, and once the front wall 22 is in the closed position, traps or catches the object 26 within the interior space 30.

As will be seen in FIG. 1 of the drawings, the bottom wall 16 of the container 12 may have a bump or ridge 44. The objective is to push the object 26 over this bump 44 and onto the bottom wall 16 in the interior space 40. The existence of the bump 44 will impede or obstruct the object 26 from falling out of the interior space 30 of the container 12, through the open space which may subsequently be created if the front wall 22 is opened to pickup another object 26.

FIG. 3 shows the pickup device 10 which has been utilized so that the object 26 has been picked up and placed within the interior space 30. The rear wall 24 is, in the embodiment shown in this figure, connected by one or more hinges 46 to the top wall 14 of the container 12. In the normal vertical carrying position, the rear wall 24 will therefore tend to remain closed, abutting against the side walls 18 and 20, and the bottom wall 16, due to the force of gravity urging it downward. When it is desired to dispose of the object 26 contained within the interior space 30, the pickup device 10 is, by means of the handle 48, maneuvered by the user so that the pickup device 10 is rotated approximately 90°, with the rear wall 24 facing downwardly, and the front wall 22 facing upwardly. In this position, since the rear wall 24 is hinged to the top wall 14, it will itself rotate about the hinge 46 as indicated by the arrow 50 in FIG. 4 of the drawings. The movement of the rear wall 24 thus causes it to open relative to the remainder of the container 12, providing egress or an exit for the object 26. This pivoting movement may be aided by the presence of a weight 53 on the rear wall 24. The object 26 will therefore simply fall out of the interior space 30, and will typically be dropped into a trash can 52. In this way, a user can conveniently and in a sanitary manner capture and dispose of an object 26 without having to touch it.

Reference is now made to FIGS. 5 and 6 of the drawings, which show a pickup device in accordance with one aspect of the invention, including the mechanism whereby the front door, of the type generally shown in FIGS. 1 to 4 or an equivalent thereof, can be opened and then sprung closed.

In FIGS. 5 and 6, there is shown a container 60, including a top wall 62 and a bottom wall 64. An interior space 66 is defined by the container.

A holding mechanism is provided for the container 60. The holding mechanism 68 essentially comprises a shaft 70 connected at its lower end to the top wall 62 of the container 60, and having a handle 72 at its upper end. The handle 72 in the embodiment shown is generally U-shaped, and is bolted to the shaft 70. The handle 72 may include a leash clip 74, generally a circular ring on the handle 72, to which one end of a leash (not shown) attached to a dog may be fastened. In this way, the user can simply hold a single item, namely, the handle 72, which will in turn attach to the leash.

The container 60 has on the outside of lateral wall 78 an enclosed channel 80. Within the channel 80, there is provided a lateral arm 82 which can slide within the channel 80, and extend beyond the channel 80 through an aperture at the front end thereof, as will be seen, for example, from FIG. 2 of the drawings. The channel 80 also contains a spring 84, one end of which fastens to the lateral arm 82 to urge it backward and into the channel 80, and another end fastened to a closed end of the channel 80, or some abutment means formed within the channel. The spring 84 tends to urge the lateral arm 82 rearwardly, in the direction as shown by the arrow 86.

The lateral arm 82, as shown in FIGS. 5 and 6 of the drawings, and a corresponding lateral arm on the other side of the container 60, is attached to the front wall of the container 22, as previously described and illustrated with respect to FIGS. 1 to 4. The movement of the lateral arm 82 in the direction opposite to that of the arrow 86 will move the door outwardly, or away from the container 60, so as to selectively create the open space into the interior space 66, when needed, and which accommodates the object 26. Such outward movement may typically be done manually.

The lateral arm 82 has along its length a recess 88 or notch, which is configured so as to maintain the lateral arm 82 with the front wall or door in the closed position, notwithstanding the force provided by the spring 84.

A trigger mechanism 94 is provided for the pickup device 96 to close the front wall when it is required to pick up an object 26. The trigger mechanism 94 comprises a series of levers and pivots, as described below.

The trigger mechanism 94 includes a catch bar 98, which is more or less vertical, and extends down the side of the container 60, through an aperture 100 in the channel 80. The catch bar 98 has a projection 102 which is received within the recess 88 when the front wall is in the open position, and holds the lateral arm 82 in the open position with the front wall open, against the bias of the spring 84. The catch bar 98 is connected to a lever arm 106 at pivot point 108. The lever arm 106 is also supported by a lever arm support 110, which extends upwardly from the top wall 62 of the container 60. The lever arm 106 is connected at pivot point 112 to the lever arm support 110. The lever arm 106 extends from the pivot point 108 to its free end 114, approximately adjacent the shaft 70.

The trigger mechanism 94 further comprises a lever catch 118. The lever catch includes a main portion 120 and a hook portion 122. The main portion 120 preferably extends through an aperture or space in or adjacent the shaft 70 and is pivotally connected thereto. The hook portion 122 engages the free end 114 of the lever arm 106.

A trigger arm 128 is provided, and is connected at pivot point 130 at one end, and extends more or less vertically adjacent the shaft 70, and passes through an aperture 132 in the handle 72.

The trigger arm 128 terminates with a ring 134 which can be manipulated by the user by using, for example, the index or another finger.

The trigger mechanism 94 further comprises a spring shaft 136 formed on the top wall 62 of the container 60. The spring shaft 136 acts on the lever arm 106 between the pivot point 112 and the free end 114 of the lever arm 106, and tends to push the lever arm 106 upwardly at the point of contact. This in turn causes the lever arm 106 to be in a lower condition at pivot point 108, so that the catch bar 98 is urged lower, thereby enabling the projection 102 to engage in the recess 88, and prevent rearward movement of the lateral arm 82 when the front wall is in the open position.

The function and operation of the pickup device 96 as shown in FIGS. 5 and 6 of the drawings will now be described. It should be noted that FIG. 5 shows the situation of the pickup device 96 in which the front wall is in a already opened position, and the interior space 66 is enclosed on three sides with the front portion open to receive the object. In FIG. 6 of the drawings, the trigger mechanism 94 has been activated to allow the front wall to be closed.

To initiate the trigger mechanism 94, the user will typically grasp the ring 134, pulling the trigger arm 128 upward as indicated by the arrow 140. When the trigger arm 128 is raised, the lever catch 118, which pivots about point 142, is pulled upward and rotates in a counterclockwise direction about the pivot point 142. As this occurs, the hook portion 122 moves correspondingly downward, applying pressure to the free end 114 of the lever arm 106. The lever arm 106 therefore moves downward at its free end 114, against the bias of the spring shaft 136. At the same time, the lever arm 106 pivots about pivot point 112, and the opposite end thereof rises at pivot point 108. As the lever arm 106 rises at pivot point 108, the catch bar 98 is pulled upwardly, and the projection 102 is moved out of the recess 88 in the lateral arm 82. Since the projection 102 acts as a stop to axial movement of the lateral arm 82, its removal from the recess 88 thereafter permits the spring 84 to urge the lateral arm 82 rearwardly in the direction of the arrow 86. Since the front wall is connected to the lateral arm 82, and to the corresponding lateral arm on the other side of the container 60, the front wall is thereby forced into the closed position, as shown in a corresponding other embodiment in FIG. 3 of the drawings.

Typically, the structure on the opposing side of the container 60 will be identical to that as shown in the side view in FIGS. 5 and 6. The lateral arm on that side will therefore also be released when the lateral arm 82 is released.

The trigger arm 128 need only be raised for a very short period of time, and can then be released. Its release will not impede the movement of the lateral arm 82, since there will be no further recesses therealong to cause such limitation. The front wall is kept in the closed position by the bias of the spring 84.

Figure 7:
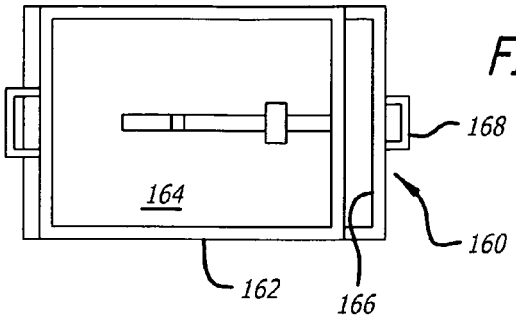
FIG. 7 is a top view of an embodiment of the invention showing various features thereof.

Reference is now made to FIGS. 7 to 10 of the drawings, which show a slightly different embodiment. FIG. 7 is a top view of a pickup device 160 comprising a container 162 which defines an interior space 164. The container 162 has a front wall 166, which is able to slide forward and backward in a manner such as that previously described in other embodiments. The front wall 166 includes a handle 168 which may be used for opening of the front wall 166.

Figure 8:
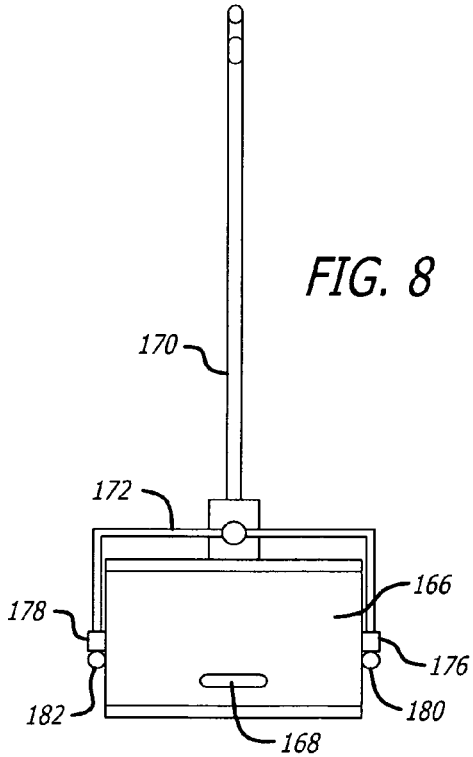
FIG. 8 is a front view of the device shown in FIG. 7 of the drawings.
Figure 9:
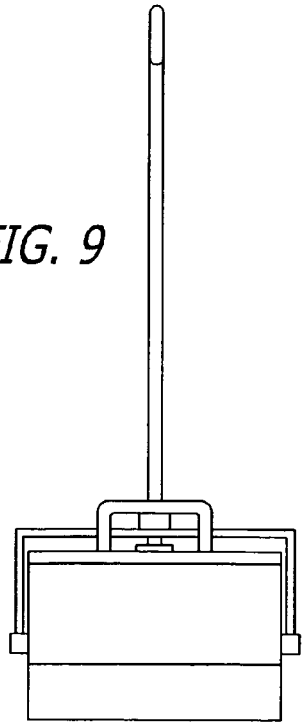
FIG. 9 is a rear view of the device shown in FIG. 7 of the drawings.

FIG. 8 shows a front view of the pickup device as shown in FIG. 7, including a shaft handle 170, by means of which the device is held. The device includes a trigger mechanism 172, comprising U-shaped bracket which can be moved up and down to selectively engage or be disengaged from a pair of opposing lateral arms 176 and 178 constructed on each side of the container 162. Each lateral arm 176 and 178 has an associated spring 180 and 182 respectively, which is preferably contained in a channel, but may be exposed as well, for urging the lateral arms 176 and 178 inwardly and toward the container upon activation of the trigger mechanism.

Figure 10:
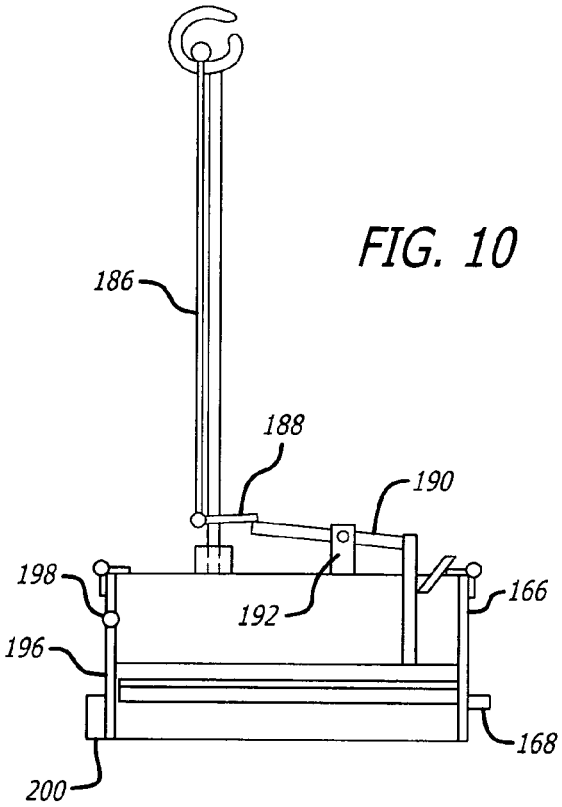
FIG. 10 is a side view of the pickup device as shown in FIG. 7 of the drawings, with certain features exposed to show the operation thereof.

FIG. 10 of the drawings shows the shaft 186, lever control 188, lever arm 190 and pivot mount 192, which are used for triggering or activating the trigger mechanism 172. FIG. 10 also shows the rear wall 196, connected to the container by means of a hinged flap 198, so that the rear door or wall 196 can pivot open when the pickup device is appropriately oriented in order to discharge or discard the object which has been picked up. FIG. 10 also shows the presence of a weight 200 positioned on the rear wall 196, the function of which is to tend to hold the rear wall 196 in the closed position against the container and prevent it from unnecessarily flapping or moving away therefrom during normal operation.

Figure 11:
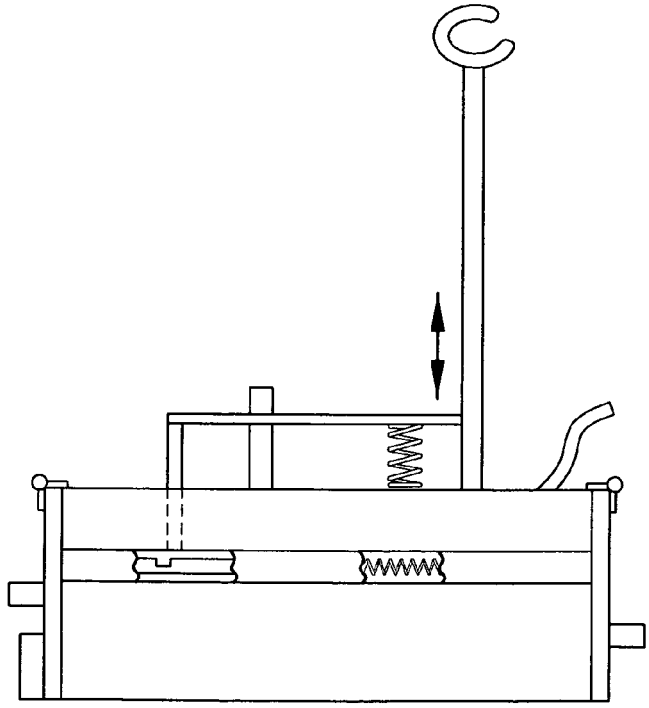
FIG. 11 is a schematic side view of another embodiment of a pickup device in accordance with the invention.
Figure 13A:
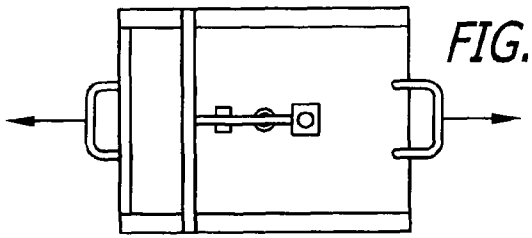
FIGS. 13(*a*) and 13 (*b*) show a schematic top and side view respectively of the container in the closed position.
Figure 13B:
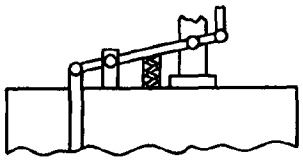
Figure 15:
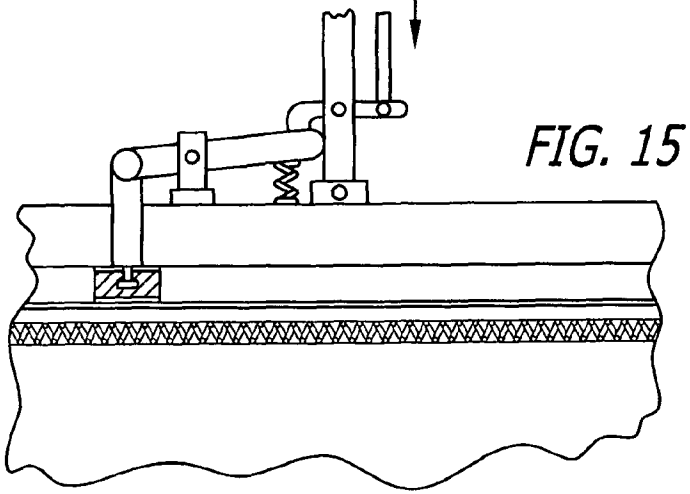
FIG. 15 is a detail schematic side view of a section of the pickup device of the invention showing certain details of the open and close mechanism.
Figure 12:
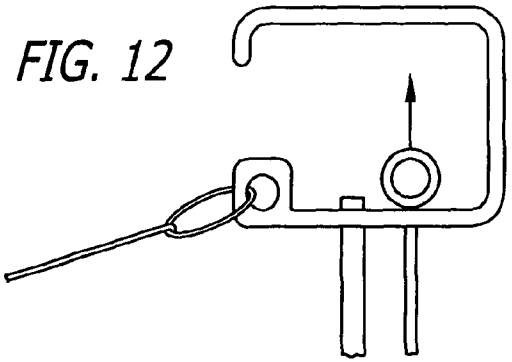
FIG. 12 is a schematic detail view of the handle of the invention in one embodiment.
Figure 14A:
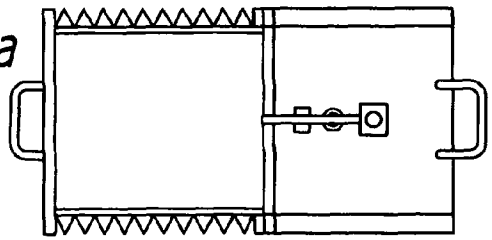
FIGS. 14(*a*) and 14(*b*) shows a top view of the container in the open position and a side view of the channel and arm respectively in accordance with an aspect of the invention.
Figure 14B:
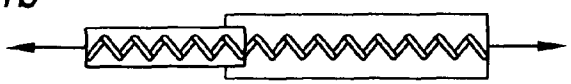

With reference to FIG. 11 of the drawings, there is shown another embodiment of the invention, not dissimilar to that shown in FIGS. 5 and 6 of the drawings. In this embodiment, the channel is formed about midway down the side of the container rather than at or near the bottom. In fact, the channel can be located at any convenient position on the lateral walls, and may even be inside the container within the interior space.

The invention is limited to the precise and specific details described herein. Variations and different modifications are within the scope of the invention and the appended claims.

The invention claimed is:

1. A pick up device comprising:

a container defining an interior space, the container having a front wall movable between an open position in which it is completely spaced from the container and a closed position, and a rear wall movable between an open position and a closed position;

a reciprocating arm associated with the container for moving the front wall between the open position away from the container and the closed position adjacent the container, the front wall being mounted only on the reciprocating arm and being moved with the reciprocating arm as it moves between the open position and the closed position, such that when the front wall is in the open position an open space is created between the container and front wall in which the front wall is not in contact with the container;

an activator for activating movement of the front wall from the open position to the closed position, the activator comprising: a channel formed on or in the container, the channel accommodating the reciprocating arm; a biasing member urging the reciprocating arm into the channel so as to move the front wall to the closed position; stop means for maintaining the reciprocating arm in the channel in the open position; and a release mechanism for selectively releasing the reciprocating arm to allow the biasing member to thereby permit movement of the reciprocating arm to move the front wall to the closed position; and connector means between the rear wall and the container allowing the rear wall to move between the open position and the closed position, the connector means permitting movement from the closed to the open position when the container is oriented at a suitable angle.

2. A pick up device as claimed in claim 1 wherein the container is generally a box shaped receptacle and comprises an upper wall, a lower wall, and side walls, the front wall and rear wall cooperating with the upper, lower and side walls to form the receptacle.

3. A pick up device as claimed in claim 1 further comprising a holding member, the holding member comprising a shaft with first and second ends, the first end of the shaft connected to the container and extending upwardly from the container, and a handle mounted on the shaft at or near the second end thereof.

4. A pick up device as claimed in claim 3 further comprising a leash connector member on the holding member.

5. A pick up device as claimed in claim 1 wherein the channel is an open channel.

6. A pick up device as claimed in claim 1 wherein the channel is a substantially closed channel.

7. A pick up device as claimed in claim 1 wherein the release mechanism comprises a trigger arm operable by a user, a catch bar which engages the reciprocating arm, and a pivoted lever arm between the trigger arm and the catch bar, the lever arm being biased so that the catch bar normally engages the reciprocating arm and being pivotable by the trigger arm to disengage the catch bar from the reciprocating arm.

8. A pick up device as claimed in claim 1 wherein two reciprocating arms are provided each on a side of the container, each of the reciprocating arms being connected at one end thereof to a side edge of the front wall.

9. A pick up device as claimed in claim 1 wherein the rear wall is hingedly connected to the container at a top edge thereof such that the rear will open by rotating at the hinge when the container is oriented at a suitable position.

10. A pick up device as claimed in claim 9 further comprising a weight attached to the rear wall of the container to stabilize the rear wall.

11. A pick up device as claimed in claim 1 further comprising a bump on the container on a bottom wall thereof adjacent the front wall, the bump preventing an object in the container from falling out of the interior space thereof.

12. A pick up device as claimed in claim 1 further comprising a handle formed on the front wall of the container to move the front wall manually into the open position.

13. A pick up device as claimed in claim 1 wherein the biasing means is a spring formed in the channel, one end of the spring being fastened to the reciprocating arm, an other end of the spring being fastened on a wall in the chamber.

14. A pick up device as claimed in claim 1 further comprising a container handle formed on the top of the container to hold or orient the container in a desired position while moving the front wall to the open position.

* * * * *